US005785508A

United States Patent [19]

Bolt

[11] Patent Number: 5,785,508

[45] Date of Patent: Jul. 28, 1998

[54] PUMP WITH REDUCED CLAMPING PRESSURE EFFECT ON FLAP VALVE

[75] Inventor: Erwin Bolt, Brugg, Switzerland

[73] Assignee: KNF Flodos AG, Sursee, Switzerland

[21] Appl. No.: 722,239

[22] PCT Filed: Apr. 11, 1995

[86] PCT No.: PCT/EP95/01317

§ 371 Date: Oct. 21, 1996

§ 102(e) Date: Oct. 21, 1996

[87] PCT Pub. No.: WO95/28569

PCT Pub. Date: Oct. 26, 1995

[30] Foreign Application Priority Data

Apr. 13, 1994 [DE] Germany ..... 44 12 668.9

[51] Int. Cl.[6] ..... F04B 39/10

[52] U.S. Cl. ..... 417/560; 417/566; 417/571; 137/855

[58] Field of Search ..... 417/560, 566, 417/571; 137/852, 855, 856, 857, 858

[56] References Cited

U.S. PATENT DOCUMENTS

| | | | |
|---|---|---|---|
| 3,514,231 | 5/1970 | Belden | 137/855 |
| 4,573,888 | 3/1986 | Kitchin | 137/855 |

FOREIGN PATENT DOCUMENTS

| | | | |
|---|---|---|---|
| 1569503 | 5/1969 | France . | |
| 1 058 798 | 6/1959 | Germany . | |
| OS 2162031 | 6/1973 | Germany . | |
| 8702221 U | 5/1987 | Germany . | |
| 181981A | 11/1982 | Japan | 417/571 |
| 63-32174 | 7/1988 | Japan . | |

*Primary Examiner*—Timothy Thorpe
*Assistant Examiner*—Cheryl J. Tyler
*Attorney, Agent, or Firm*—Panitch Schwarze Jacobs & Nadel, P.C.

[57] ABSTRACT

In a diaphragm pump flap valves accommodated in a pump head are provided which have a valve disk in which are situated valve flaps (14) circumscribed by partial ring-shaped recesses. These are respectively flexibly connected with the remaining valve disk (15) by means of a web (17). The valve disk is clamped between pump head elements in an area circumscribing each respective valve. In order to avoid material displacements and deformations resulting from the clamping from acting upon the web and the valve flap (14), it is provided that an opening (19) of the valve disk (15) is situated in a connecting area between valve flap (14), web (17) and outer clamping (18), facing away from the valve flap (14). Material displacements originating from the clamping area (18) can thereby no longer influence the valve flap (14) and the web (17), since a transmission of these material deformations is interrupted in the area of the opening (19).

9 Claims, 2 Drawing Sheets

PUMP WITH REDUCED CLAMPING PRESSURE EFFECT ON FLAP VALVE

BACKGROUND OF THE INVENTION

The invention relates to a pump with flap valves accommodated in the pump head and controlled by the flow medium, which in the closed position lie on a valve sealing surface of the pump head, while in the open position they withdraw into a recess of the valve head for the valve opening movement, wherein the valves have one or more valve disks made of rubber or a rubber-like material, in which are located valve flaps circumscribed by openings, particularly of partial ring shape, which are flexibly connected with the remaining valve disk(s) by means of a web, and wherein in each case the valve disk is clamped between pump head elements in the area which circumscribes a valve.

In order to obtain a good self-aspirating behavior and a good volumetric efficiency with such liquid and gas pumps constructed as diaphragm pumps, it is important that the valves execute their opening and closing movement as synchronously or congruently as possible with the diaphragm lifting and lowering motion and consequently attain the longest opening and closing times possible. In diaphragm pumps with flap valves there exists the problem that a pressure impingement occurs in the outer clamping area of the valve disks by the pump head parts on the valve plates located in between, which are made of rubber or a rubber-like material, and that this leads to a material displacement. The displaced material also affects the valve flaps owing to the closeness of the clamping place, since a transmission is possible over the bridge-like coupling web.

The material displacement can lead to an unwanted deformation of the web, and of the valve flap as well. An impairment, however, results from such a deformation of the web or the valve flap in the sense that the opening and closing movement or the opening and closing speed is impeded. A diminution of valve reaction time results from this.

SUMMARY OF THE INVENTION

An object of the present invention is to create a pump with flap valves of the type mentioned at the beginning, whose reaction times are improved, so that the pump can also be used particularly well for high operating speeds. The self-aspirating behavior and the volumetric efficiency should also be improved thereby.

For accomplishing this object it is particularly proposed in accordance with the invention, that at least one opening or break in the valve disk be provided in a connecting area between valve flap, web and outer clamping adjacent to the web, facing away from the valve flap, and that the width of the opening in the direction of the line connecting between valve flap, web and outer clamping appropriately corresponds at least to the size of a material displacement arising from the outer clamping.

Owing to the opening provided, material displacements arising from the clamping area no longer reach the web and through this into the area of the valve flap. A buffer space is practically created by the break or opening, in which material displacements that occur can be diverted without having further effects on the other side.

To be sure, one could also enlarge the distance between the outer clamping and the valve flap or web to reduce the effects of the material displacement which arises. This is, however, not practically possible due to the confined spatial relationships in the pump head.

With the solution of the invention, on the other hand, the effects of the material displacement can be kept practically completely away from the valve flap, while this is also easily possible under the given confined spatial relations. Through the provided width of the recess sufficient free space is thereby created to keep away material shifts or material displacements arising from clamping the valve disks in the direction toward the web and the valve flap.

The opening in the valve disk located in the extension of the valve flap and web preferably extends laterally and preferably symmetrically out past the direct projection extension of the web. The length of the opening preferably corresponds to about 2 to about 8 times the width of the web, and the distance of the opening from the web corresponds to about 0.5 to 2 times the web width.

A lateral "by-pass" of the opening, exerting an effect on the valve flap, is thereby safely avoided.

BRIEF DESCRIPTION OF THE SEVERAL VIEWS OF THE DRAWINGS

Additional configurations of the invention are set forth in the dependent claims. The invention with its essential details is discussed in detail below on the basis of the drawings. In the drawings:

DETAILED DESCRIPTION OF THE INVENTION

Figure 1:
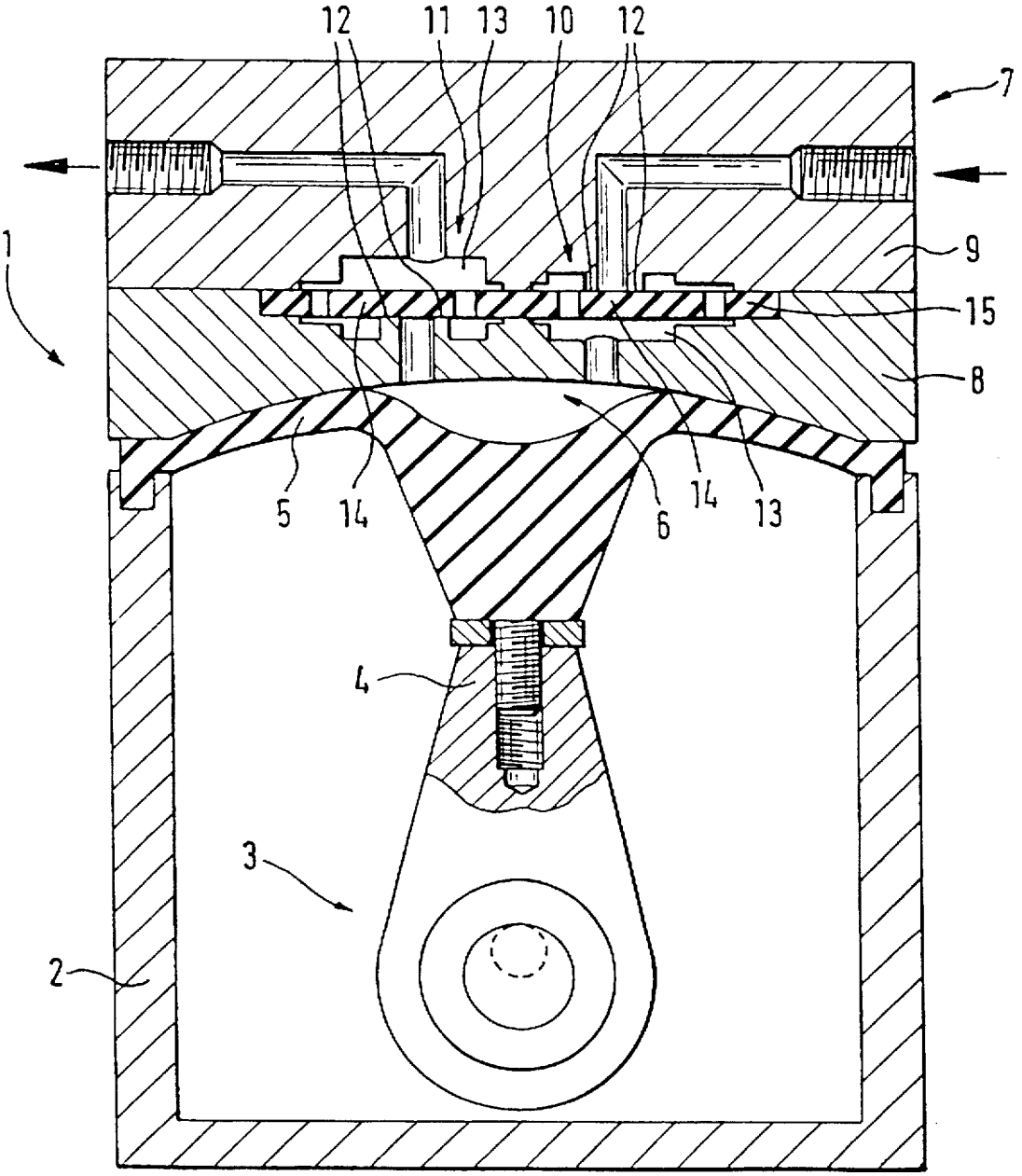
FIG. 1 is a longitudinal sectional view of a diaphragm pump with flap valves.

A diaphragm pump 1 depicted in FIG. 1 has in a crankcase 2 a crank assembly 3, which is connected with a diaphragm 5 through a piston rod 4. The pump area 6 bounded on one side by the diaphragm 5 is circumscribed on the opposite side by an intermediate plate 8 belonging to the pump head 7. A head plate 9 is joined to the intermediate plate 8.

An intake valve 10 as well as an outlet valve 11 are situated in the pump head 7. Both valves are constructed as flap valves, which at all times lie against valve sealing surfaces 12 in the closed position. Opposite these valve sealing surfaces 12 are found respective recesses 13, into which the valve flaps 14 belonging to the valves can recede during a valve opening motion.

The valves advantageously have a common valve disk 15, in which the valve flaps 14 bounded by partial ring-shaped openings 16 (see FIG. 3) are located. The valve disk 15 is clamped between the cover plate 9 and the intermediate plate 8 of the pump head 7. The clamping places at the same time circumscribe the area of the intake valve 10 and the outlet valve 11 in each case, and also seal these areas from each other.

Figure 2:
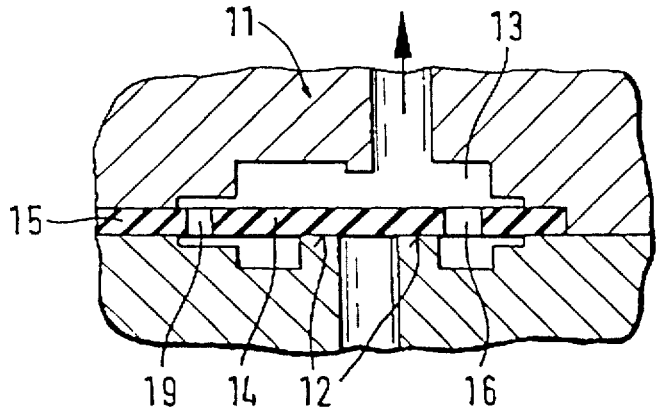
FIG. 2 is a detail view in the area of a valve in longitudinal section taken along line 2—2 in FIG. 3.
Figure 3:
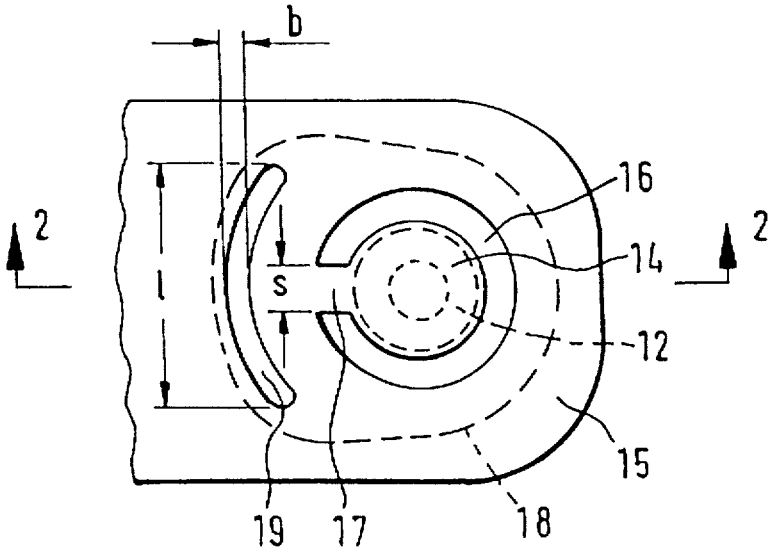
FIG. 3 is a partial view of a valve plate.

As can be well recognized in FIGS. 2 and 3, a web 17 is situated between the opposite ends of the partial ring-shaped opening 16 circumscribing the valve flaps 14, on which the valve flap 14 is movably held, and is connected with the remaining valve disk 15.

As already mentioned above, the valve disk 15 is clamped in the area (bounded by the dashed line in FIG. 3) between the cover plate 9 and the intermediate plate 8 (see also FIG. 2). The material of the elastic valve disk 15 located in between is necessarily somewhat displaced by this clamping. If the effects of such a material displacement reach into the area of the bridge-like web 17 or also into the area of the valve flap 14, a corresponding deformation can take place owing to this. Such a deformation can have as a consequence that the bending stability is uncontrollably altered in the area of the valve flap and/or the web 17, so that because of this the anticipated course of movement in opening and closing the valve flap 14 can no longer be guaranteed to the desired extent.

In order to prevent such clamping deformations from extending into the valve flap 14 region and also into the web 17 area, an opening 19 is provided in the valve disk between the clamping area 18, adjacent to the web 17. This opening 19 forms a break and a buffer area in the connection region between the web 17 and the clamping area 18 through which a transmission of material deformations from the clamping area 18 to the web 17 and over this to the valve flap 14 is prevented.

In the embodiment shown the opening 19 is configured as a circle segment-shaped slit, which continues somewhat past the width of the web area on both sides concentrically to the valve flap (14). The length l of this opening-slit is at the same time so proportioned that the deformations of the valve disk 15 emerging from the clamping area 18 cannot propagate themselves up to the web or to the valve flap 14. The same also applies for the position of the opening 19 relative to the web 17, especially with regard to the distance to the web 17 and with regard to the the slit width b as well. Preferably the length of the opening-slit 19 comes to about five times the web width s. The distance from the opening 19 to the web 17 corresponds approximately to the width of the web. The circle segment-shaped construction of the slit-shaped opening 19 depicted is particularly favorable under the spatial conditions available.

FIG. 2 permits easy recognition of the fact that a small distance from the valve disk 15 respectively to the cover plate 9 or to the intermediate plate 8 suffices in the area of the opening 19. By keeping deformations originating from material displacements away from the valve flaps 14, these areas remain free from external tensions, whereby short reaction times of the valves with long opening and closing times can be realized.

I claim:

1. A pump comprising flow medium-controlled intake and output valves, a pump head having a cover plate and an intermediate plate, a valve disk made of a rubber or rubber-like material clamped between the cover plate and the intermediate plate, valve flaps being located in the valve disk, the valve flaps lie on valve sealing surfaces in a closed position and recede into recesses located in the pump head for opening movement, at least one valve flap being formed by a partial ring-shaped opening in the valve disk and being flexibly connected to the valve disk by a web, the valve disk having a clamped area circumscribing the valve flaps, the clamped area being clamped in the pump head, wherein the valve disk (15) is provided with an opening (19) located in a connecting area between the web (17) and an outer periphery of the clamped area (18) of the valve disk (15), said opening being in a recessed area of the pump head adjacent to the web, and having a width (b) which is at least equal to a width of material displaced to prevent material deformation from the clamped area to the valve flap.

2. The pump according to claim 1, wherein the web has a width defined between two opposing sides located at opposite edges of the web, and the opening (19) extends laterally past each of the two opposing sides of the web.

3. The pump according to claim 2, wherein the opening extends symmetrically out past the width defined between the two opposing sides of the web.

4. The pump according to claim 1, wherein the opening is constructed as a slit.

5. The pump according to claim 4, wherein the slit is circle segment-shaped and is arranged at a distance from the web concentrically to the valve flap (14).

6. The pump according to claim 2, wherein the opening (19) extends laterally over a length (l) corresponding to about 2 to about 8 times a width (s) of the web.

7. The pump according to claim 6, wherein the length (l) corresponds to about 5 times the width (s).

8. The pump according to claim 4, wherein the opening (19) is spaced a distance from the web (17) which corresponds to about 0.5 to 2 times a width (s) of the web.

9. A pump comprising flow medium-controlled intake and output valves, a pump head having a cover plate and an intermediate plate, a valve disk made of a rubber or rubber-like material clamped between the cover plate and the intermediate plate, valve flaps being located in the valve disk, the valve flaps lie on valve sealing surfaces in a closed position and recede into recesses located in the pump head for opening movement, each valve flap being formed by a partial ring-shaped opening in the valve disk and being flexibly connected to the valve disk by a web, the valve disk having a clamped area circumscribing the valve flaps, the clamped area being clamped in the pump head, wherein the valve disk (15) is provided with an opening (19) located in a connecting area between each web (17) of each valve flap and an outer periphery of the clamped area (18) of the valve disk (15), each said opening being in a recessed area of the pump head adjacent to the respective web, and having a width (b) which is at least equal to a width of material displaced to prevent material deformation from the clamped area to the valve flap.

* * * * *